US010808569B2

(12) United States Patent
Boening et al.

(10) Patent No.: US 10,808,569 B2
(45) Date of Patent: Oct. 20, 2020

(54) TURBOCHARGER

(71) Applicant: CONTINENTAL AUTOMOTIVE GMBH, Hannover (DE)

(72) Inventors: Ralf Boening, Reiffelbach (DE); Ivo Sandor, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 595 days.

(21) Appl. No.: 15/103,541

(22) PCT Filed: Oct. 22, 2014

(86) PCT No.: PCT/EP2014/072600
§ 371 (c)(1),
(2) Date: Jun. 10, 2016

(87) PCT Pub. No.: WO2015/086205
PCT Pub. Date: Jun. 18, 2015

(65) Prior Publication Data

US 2016/0312651 A1 Oct. 27, 2016

(30) Foreign Application Priority Data

Dec. 11, 2013 (DE) ..... 10 2013 225 642

(51) Int. Cl.
*F01D 17/16* (2006.01)
*F01D 5/04* (2006.01)

(52) U.S. Cl.
CPC ..... *F01D 17/165* (2013.01); *F01D 5/048* (2013.01); *F05D 2220/40* (2013.01)

(58) Field of Classification Search
CPC ..... F01D 17/165; F01D 5/043; F01D 5/048; F05D 2220/40
(Continued)

(56) References Cited

U.S. PATENT DOCUMENTS 2,797,858 A * 7/1957 Von Der Nuell ..... F01D 1/08 415/148
3,495,921 A 2/1970 Swearingen
(Continued)

FOREIGN PATENT DOCUMENTS

CN 202176551 U 3/2012
EP 1710415 A1 10/2006
(Continued)

OTHER PUBLICATIONS

English machine translation of EP 1710415, Oct. 2006.*
English machine translation of CN 202176551, Mar. 2012.*

*Primary Examiner* — Christopher Verdier
(74) *Attorney, Agent, or Firm* — Laurence A. Greenberg; Werner H. Stemer; Ralph E. Locher

(57) ABSTRACT

An exhaust gas turbocharger has a turbine with a turbine wheel. The turbine wheel is axially mounted in a turbine housing and has turbine blades, each with a leading edge for a flow of media. An adjustable guide grate with a plurality of stator vanes adjusts a flow cross-section relative to the leading edge of the turbine wheel. Each stator vane has a vane rear edge facing the turbine wheel. A plane is defined by a rotational axis of the turbine wheel and at least one point on the leading edge, wherein a projection of the leading edge onto the plane is axially inclined relative to the rotational axis of the turbine wheel at least in one region, and the stator vanes are arranged radially about the turbine wheel at least in the region.

7 Claims, 6 Drawing Sheets

(58) Field of Classification Search
USPC ..... 415/163, 164, 203–206; 417/407
See application file for complete search history.

(56) References Cited

U.S. PATENT DOCUMENTS

| | | | | |
|---|---|---|---|---|
| 9,810,225 | B2 * | 11/2017 | Yokoyama | F01D 9/026 |
| 2007/0172348 | A1 * | 7/2007 | Battig | F01D 17/165 415/160 |
| 2008/0075583 | A1 * | 3/2008 | Schlienger | F01D 11/00 415/159 |
| 2008/0260528 | A1 * | 10/2008 | Weber | F01D 17/165 415/208.2 |
| 2010/0104424 | A1 | 4/2010 | Anschel et al. | |
| 2010/0293942 | A1 * | 11/2010 | Martinez-Botas | F01D 17/165 60/602 |
| 2010/0296924 | A1 * | 11/2010 | Boning | F01D 5/141 415/208.1 |
| 2011/0167817 | A1 | 7/2011 | Sausse et al. | |
| 2011/0206500 | A1 * | 8/2011 | Nagao | F01D 5/141 415/148 |
| 2011/0314808 | A1 * | 12/2011 | Mohamed | F01D 5/141 60/602 |
| 2013/0195629 | A1 * | 8/2013 | Morand | F01D 9/048 415/148 |
| 2014/0112764 | A1 * | 4/2014 | Morita | F01D 5/141 415/165 |
| 2014/0341729 | A1 * | 11/2014 | Osako | F01D 17/165 415/208.1 |
| 2015/0016968 | A1 | 1/2015 | Grabowska et al. | |

FOREIGN PATENT DOCUMENTS

| | | | | |
|---|---|---|---|---|
| EP | 1895106 | A1 | 3/2008 | |
| WO | 2004022926 | A1 | 3/2004 | |
| WO | 2008137410 | A2 | 11/2008 | |
| WO | 2013080795 | A1 | 6/2013 | |
| WO | WO-2013/099410 | A1 * | 7/2013 | F01D 9/026 |
| WO | 2013116136 | A1 | 8/2013 | |

* cited by examiner

FIG. 6A
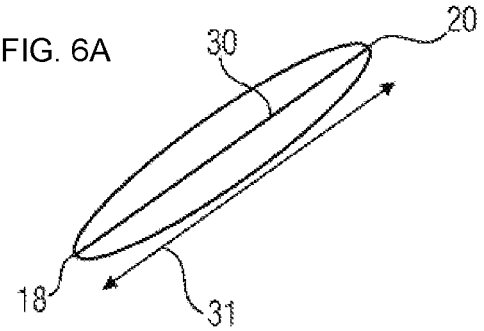
FIG. 6B
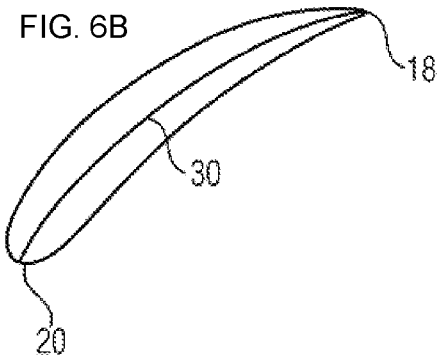
FIG. 6C
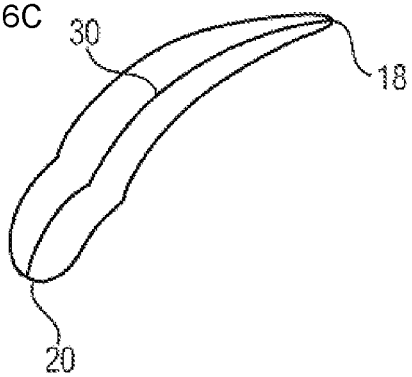
FIG. 6D
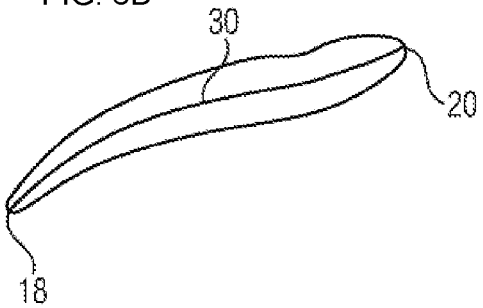
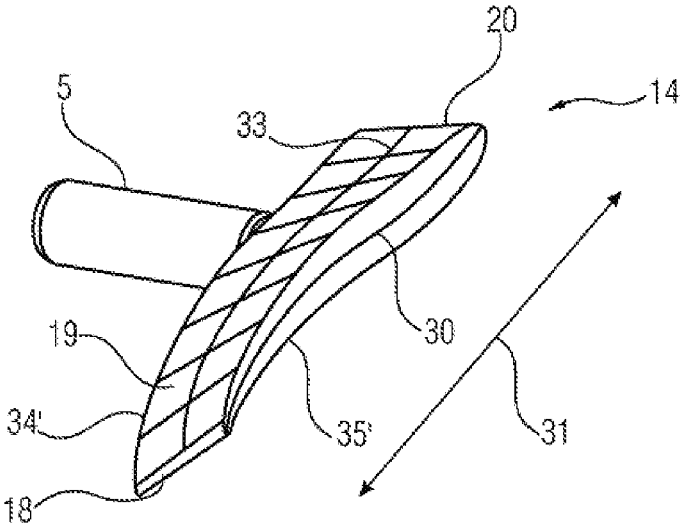
FIG 7

TURBOCHARGER

BACKGROUND OF THE INVENTION

Field of the Invention

The invention relates to an exhaust-gas turbocharger comprising a turbine with a turbine wheel. The turbine wheel is mounted axially in a turbine housing and has turbine vanes with in each case one inlet edge for a medium flow. In the turbine housing there is arranged an adjustable guide grate with a multiplicity of guide vanes for the variable adjustment of a flow cross section with respect to the inlet edge of the turbine wheel. The guide vanes each have a vane trailing edge, facing toward the turbine wheel, and a vane leading edge, averted from the turbine wheel.

By way of an exhaust-gas turbocharger, additional fresh air can be supplied to an internal combustion engine, whereby more fuel can be burned. Accordingly, the exhaust-gas turbocharger can increase the power of the internal combustion engine. Furthermore, exhaust-gas turbochargers are also capable of increasing the efficiency of the internal combustion engine.

Typically, an exhaust-gas turbocharger has a turbine with a turbine wheel and a compressor with a compressor wheel, wherein the turbine wheel and the compressor wheel are normally arranged on a common shaft. Here, the turbine wheel is driven by way of an exhaust-gas mass flow of the internal combustion engine, and said exhaust-gas mass flow in turn drives the compressor wheel. The compressor, also referred to as supercharging blower, compresses fresh air that is drawn in, and conducts said fresh air to the internal combustion engine. The common shaft of the compressor and of the turbine is often mounted in a bearing housing of the turbocharger. Furthermore, the turbine wheel of the turbine is for example arranged in a turbine housing, and correspondingly, the compressor wheel of the compressor is arranged in a compressor housing.

To improve an adaptation of the turbine power to operation of the internal combustion engine, so-called variable turbine geometry adjustment systems have been developed in particular in the case of diesel engines, but recently also in the case of Otto-cycle engines. Here, the most common form of variable turbine geometry is composed of an upstream guide grate with adjustable guide vanes, which are arranged upstream of the turbine wheel. The guide vanes can be adjusted between an open position and a closed position in a manner dependent on the present operating state of the internal combustion engine. By way of the adjustment of the guide vanes and of the guide grate, it is possible for an exhaust-gas back pressure, and also the manner in which the exhaust-gas mass flow approaches the turbine wheel, to be influenced. It is thus possible for a flow cross section of the exhaust-gas mass flow to the turbine wheel to be varied. The flow cross section of the exhaust-gas mass flow to the turbine wheel is in this case at its greatest in the open position of the guide vanes and at its smallest in the closed position. In the presence of a relatively low exhaust-gas mass flow, the guide vanes are moved into the closed position. Owing to the small flow cross section in the closed position, the speed of the exhaust-gas mass flow is increased between the guide vanes. The exhaust-gas mass flow thus impinges on the turbine vanes at a higher speed, whereby the rotational speed of the shaft, and thus the power of the exhaust-gas turbocharger, increase. In this way, it is possible even in the presence of a low exhaust-gas mass flow for a sufficient amount of fresh air to be compressed by the compressor and supplied to the internal combustion engine. Thus, the power of the exhaust-gas turbocharger can be adjusted to the operating state of the internal combustion engine in accordance with demand.

BRIEF SUMMARY OF THE INVENTION

The invention is based on the object of developing an improved exhaust-gas turbocharger, in the case of which the power is increased in particular in a low engine speed range of the internal combustion engine.

Said object is achieved by way of an exhaust-gas turbocharger having the features of the main claim. Further embodiments of the invention will emerge from the features of the sub claims and of the exemplary embodiments.

The exhaust-gas turbocharger according to the invention comprises a turbine with a turbine wheel, wherein the turbine wheel is mounted axially in a turbine housing and has turbine vanes with in each case one inlet edge for a medium flow. In the turbine housing, there is arranged an adjustable guide grate with a multiplicity of guide vanes for the variable adjustment of a flow cross section with respect to the inlet edge of the turbine wheel. The guide vanes each have a vane trailing edge, facing toward the turbine wheel, and a vane leading edge, averted from the turbine wheel. A plane is spanned by an axis of rotation of the turbine wheel and at least one point that lies on the inlet edge. A projection of the inlet edge onto said plane is, at least in one region, inclined axially in relation to the axis of rotation of the turbine wheel (inclined inlet edge). Furthermore, the guide vanes are, at least in said region, arranged radially around the turbine wheel. An example of such an inclined inlet edge of a turbine wheel is shown in FIG. 10 for illustrative purposes.

In the context of the present application, the projection of the inlet edge onto the plane is to be understood to mean a representation of a three-dimensional inlet edge on a two-dimensional plane. A turbine with such an inclined inlet edge is also referred to as radial-axial turbine or turbine with semi-axial inflow. Typically, a radial spacing of the inlet edge perpendicular to the axis of rotation of the turbine wheel varies in said region.

By way of the invention, the advantages of a turbine with semi-axial inflow can be combined with the advantages of a turbine with an adjustable guide grate, wherein the guide grate has a multiplicity of guide vanes. By way of the inclined inlet edge, the turbine wheel can have a lower moment of inertia than a turbine wheel with a projection of an inlet edge onto the stated plane parallel to the axis of rotation of the turbine wheel (straight inlet edge), which is also referred to as a turbine wheel with radial inflow. In this way, the power and the response characteristic of the exhaust-gas turbocharger, in particular in a range of low engine speed of the internal combustion engine, are increased. The adjustable guide vanes likewise serve to realize an improvement in the power of the internal combustion engine in the low engine speed range.

Owing to the relatively low moment of inertia, the turbine wheel according to the invention can be of smaller construction than turbine wheels with a straight inlet edge. In this way, the upstream guide grate can be designed to be smaller and to have fewer guide vanes. Consequently, costs can be saved.

Outside the stated region, the projection of the inlet edge onto the plane may also be at least partially parallel to the axis of rotation of the turbine wheel.

The axially inclined projection of the inlet edge may, in sections, be inclined by an angle of at least 30° in relation to the axis of rotation of the turbine wheel. Said angle may have a constant value. In typical embodiments, said angle is less than 60°. An example of a projection, inclined by an angle φ in relation to an axis of rotation of a turbine wheel, of an inlet edge is shown for illustrative purposes in FIG. 10.

It is preferably likewise the case that a projection of the vane trailing edge onto said plane is, at least in the stated region, inclined axially in relation to the axis of rotation. In this way, guidance of the medium flow from the guide vanes to the turbine wheel can be improved.

The vane trailing edge of in each case one guide vane preferably runs substantially parallel to the inlet edge of a respectively closest turbine vane. The vane trailing edge has the same angle of inclination in relation to the axis of rotation of the turbine wheel as the inlet edge. In this case, therefore, the projection of the vane trailing edge is typically parallel to the projection of the inlet edge. Typically, a gap between the vane trailing edge and the inlet edge thus has substantially a constant value. The guidance of the medium flow from the guide vanes to the turbine wheel can thereby be improved.

Normally, the guide vanes are adjustable between an open position and a closed position. At least in the open position, a minimum radial spacing of the vane trailing edge of in each case one guide vane perpendicular to the axis of rotation of the turbine wheel may be smaller than a maximum radial spacing of the inlet edge of a respectively closest turbine vane perpendicular to the axis of rotation of the turbine wheel. In this case, the vane trailing edge thus undercuts, as viewed in a radial direction, the inlet edge of a closest turbine vane. In this way, the medium flow can be conducted as close as possible to the turbine wheel. A gap width between vane trailing edge and inlet edge is preferably minimal. For example, the gap width is less than 2 mm. Taking into consideration manufacturing and assembly tolerances, the gap width is however typically greater than 0.5 mm. In a preferred embodiment, the gap width is 1 mm.

It is preferable for a first cross section of in each case one guide vane perpendicular to the axis of rotation of the turbine wheel to be inclined by an angle in relation to a second cross section of the respective guide vane perpendicular to the axis of rotation of the turbine wheel. That is to say, in this embodiment, the guide vane has a twisted form. Owing to the twisted form of the guide vane, the medium flow, before it strikes the inlet edge, has a speed component parallel to the axis of rotation, that is to say in an axial direction, imparted to it in addition to a speed component perpendicular to the axis of rotation. In this way, guidance of the medium flow from the guide vane to the turbine wheel is improved. The first cross section may be inclined by an angle of greater than 5° in relation to the second cross section. Said angle is typically less than 25°.

For further improvement of the flow guidance, it is possible for at least two cross sections of in each case one guide vane perpendicular to the axis of rotation to have in each case a different shape.

In the present document, different flow filaments or flow lines define in each case a smallest spacing, on a guide vane surface that guides the medium flow, from the vane leading edge to the vane trailing edge. The different flow filaments or flow lines are preferably each of equal length. For example, in the case of guide vanes of twisted shape or in the case of differently shaped cross sections of a guide vane, the flow filaments or flow lines may have in each case an equal length. Different flow paths of the exhaust-gas mass flow on the guide vane are then of equal length. In this way, the guidance of the medium flow from the guide vane to the turbine wheel is particularly expedient.

According to a further definition, profile centerlines of in each case one guide vane divide in each case one cross section of the guide vane perpendicular to the axis of rotation along the length thereof into two halves of equal thickness. Here, the profile centerlines extend from the vane trailing edge to the vane leading edge of the guide vane. The profile centerlines are preferably curved at least in sections. In this way, the flow guidance from the guide vane to the turbine wheel can be further improved.

The profile centerline that is curved at least in sections may have a single constant radius of curvature. In other embodiments, it may also regionally have in each case different radii of curvature. Provision may be made for the profile centerline to be straight in a first region and to be curved in a second region. All of the profile centerlines of in each case one guide vane are preferably of the same shape. Alternatively, the profile centerline may also be varied within the respective guide vane.

A guide vane surface which guides the medium flow and which extends from the vane trailing edge to the vane leading edge of the guide vane is typically arched.

The vane leading edge and the vane trailing edge of two adjacent guide vanes are preferably shaped such that, in the closed position of the guide vanes, they form an aperture for guidance of the medium flow to the turbine wheel. It is preferable for a shape of the vane leading edge to be adapted to a shape of the vane trailing edge in order to form a streamlined nozzle. In this way, expedient guidance of the medium flow can be realized.

In typical embodiments, the turbine wheel is mounted together with a compressor wheel on a shaft, wherein the shaft is mounted in a bearing housing. Normally, the guide vanes are fastened to guide vane shafts, wherein the guide vane shafts are arranged rotatably in a vane bearing ring. A heat shield is preferably arranged, so as to exhibit a flow-guiding action, between the vane bearing ring and the shaft. The heat shield can reduce an introduction of heat into said bearing housing, and can ensure improved guidance of the medium flow from the guide vanes to the turbine wheel.

Owing to the above-described improvements of the guidance of the medium flow from the guide vanes to the turbine wheel, it is possible to achieve lower flow losses, which leads to improved efficiency of the turbine.

In accordance with the invention, there is provided an exhaust gas turbocharger, including: a turbine housing, and a turbine with a turbine wheel axially mounted in the turbine housing and rotatable about an axis of rotation. The turbine wheel has turbine vanes each formed with an inlet edge for a medium flow. The exhaust gas turbocharger also includes an adjustable guide grate disposed in the turbine housing. The adjustable guide grate has a multiplicity of guide vanes for a variable adjustment of a flow cross section with respect to the inlet edges of the turbine wheel. Each of the guide vanes has a continuous vane trailing edge, facing toward the turbine wheel, and a continuous vane leading edge averted from the turbine wheel. A plane is spanned by the axis of rotation of the turbine wheel and at least one point on the inlet edge, and a projection of the inlet edge onto the plane is, at least in one region, axially inclined relative to the axis of rotation of the turbine wheel. The guide vanes are, at least in the at least one region, arranged radially around the turbine wheel. Different flow-lines define, in each case, a smallest spacing, on a guide vane surface, from the vane leading edge to the vane trailing edge. The different flow-lines have an equal length. Each of the guide vanes has a main body with at least two cross sections that have mutually different shapes perpendicular to the axis of rotation, and the at least two cross sections are located completely within a region bounded by the continuous vane trailing edge and the continuous vane leading edge. The two cross sections are twisted relative to one another by an angle.

BRIEF DESCRIPTION OF THE SEVERAL VIEWS OF THE DRAWING

Exemplary embodiments will be discussed on the basis of the appended figures, in which:

FIGS. 6A-6D show various cross sections of a guide vane;

FIG. 7 is a perspective illustration of a guide vane arranged on a guide vane shaft;

Functionally identical parts, or repeated features, are denoted throughout the figures by the same reference designations.

DESCRIPTION OF THE INVENTION

Figure 1:
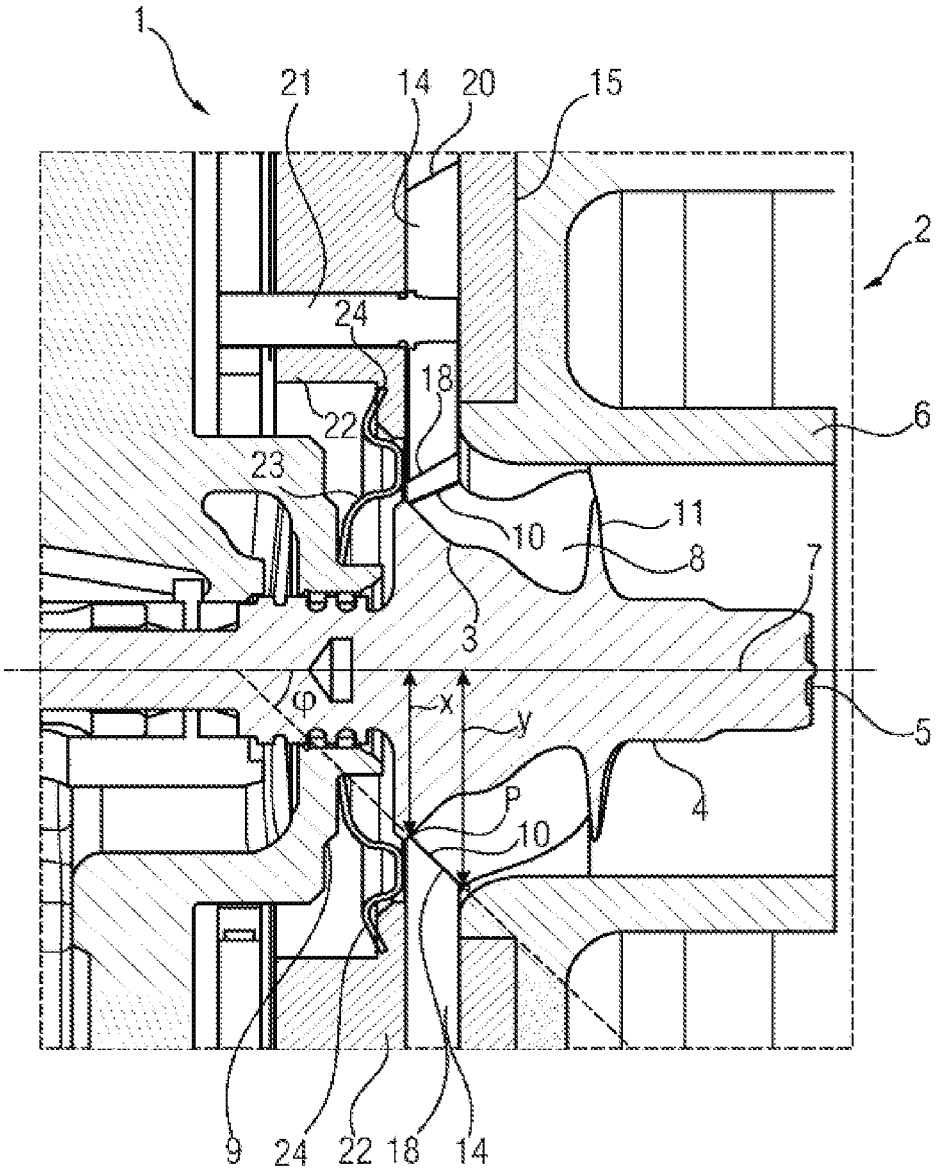
FIG. 1 shows a cross section of a turbine-side section of an exhaust-gas turbocharger.

FIG. 1 shows a cross section of a section of an exhaust-gas turbocharger 1. In the section shown, a turbine 2 with a turbine wheel 4 is shown. The turbine wheel 4 is mounted axially on a shaft 5, which defines an axis of rotation 7, in a turbine housing 6. Likewise situated on the shaft 5 is a compressor wheel (not shown) in a compressor housing. The shaft 5 of the turbine wheel 4 and of the compressor wheel is mounted in a bearing housing 9.

The turbine wheel 4 has a hub 3 with turbine vanes 8 arranged thereon. The turbine vanes 8 comprise in each case an inlet edge 10 and a trailing edge 11 for an exhaust-gas mass flow from an internal combustion engine. In the example shown, the internal combustion engine is a diesel engine. Alternatively, however, the internal combustion engine may also be an Otto-cycle engine.

The exhaust-gas turbocharger 1 has a variable turbine geometry, which comprises an adjustable guide grate 12 with a multiplicity of guide vanes 14 for the variable adjustment of a flow cross section 16 with respect to the stated inlet edge 10 of the turbine wheel 4, wherein the guide grate 12 is arranged in the turbine housing 6. By way of the guide vanes 14, the exhaust-gas mass flow is conducted to the turbine vanes 8 of the turbine wheel 4. Here, the exhaust-gas mass flow impinges firstly on a vane leading edge 20, which is averted from the turbine wheel 4, and passes over a vane surface 19 and over a vane trailing edge 18, which faces toward the turbine wheel, to the inlet edge 10 of the turbine wheel 4.

The guide vanes 14 are adjustable between an open position and a closed position. For this purpose, the guide vanes 14 are arranged on guide vane shafts 21, which are mounted rotatably in a guide vane bearing ring 22. The guide vanes 14 are delimited by the guide vane bearing ring 22 and a disk 15. The guide vanes 14 of the guide grate 12 can be adjusted, in a manner dependent on an operating state of the internal combustion engine, by way of an electrical actuator (not illustrated). The actuator may alternatively be in the form of a pressure capsule.

Between the hub 3 and the guide vane bearing ring 22, there is arranged a heat shield 23 which reduces an introduction of heat from the exhaust-gas mass flow into a bearing arrangement of the shaft 5 in the bearing housing 9. To compensate temperature-induced bending, the heat shield 23 is arranged resiliently on a spring arm 24, and is braced between the vane bearing ring 22 and the bearing housing 9. Furthermore, the heat shield 23 promotes guidance of the exhaust-gas mass flow to the turbine wheel 4. During the rotation of the guide vane shafts 21 from the closed position into the open position of the guide vanes 14, the guide vanes 14 are pivoted over the heat shield 23.

In FIG. 1, a plane is spanned by the axis of rotation 7 of the turbine wheel 4 and by a point P that lies on the inlet edge 10. It can be seen that a projection of the three-dimensional inlet edge 10 onto said plane is inclined axially in relation to the axis of rotation 7 of the turbine wheel 4. The guide vanes 14 are arranged radially around the inlet edge 10 of the turbine wheel 4. In the figure, the projection of the entire inlet edge 10 is inclined.

The described axially inclined projection of the inlet edge 10 onto said plane is commonly referred to as an inclined or oblique inlet edge 10. The turbine 2 shown in FIG. 1 is thus a turbine with semi-axial inflow. The exhaust-gas mass flow flows out of a flow housing (not shown) of the turbine in a predominantly radial direction onto the leading edges 20 of the guide vanes 14, whereas it impinges not only with a radial flow component but also with an axial flow component on the inlet edge 10 of the turbine vanes 8.

The axially inclined projection of the inlet edge 10 onto said plane is inclined by an angle φ of approximately 48° relative to the axis of rotation 7 of the turbine wheel 4.

It can likewise be seen that a projection of the vane trailing edge 18 onto said plane is axially inclined relative to the axis of rotation 7 by the same angle φ of approximately 48°. Thus, the vane trailing edge 18 runs substantially parallel to the inlet edge 10 of a respectively closest turbine vane 8. A gap 26 between inlet edge 10 and blade trailing edge 18 is thus of substantially constant thickness, and is approximately 1 mm.

The guide vanes 14 shown in FIG. 1 are situated in an open position. In said position, a minimum radial spacing x of the vane trailing edge 18 of in each case one guide vane 14 perpendicular to the axis of rotation 7 is smaller than a maximum radial spacing y of the inlet edge 10 of a respectively closest turbine vane 14 perpendicular to the axis of rotation 7. The guide vanes 14 thus undercut the turbine vanes 8 in the region of the inlet edge 10.

Figure 2:
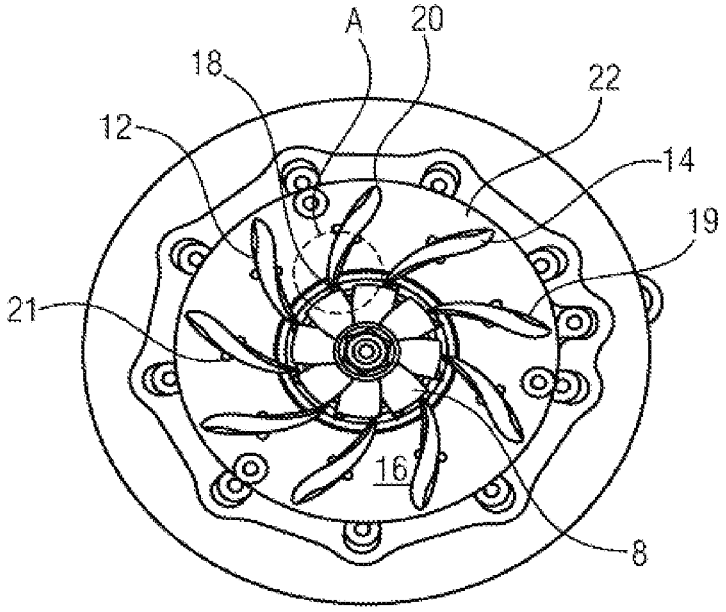
FIG. 2 shows a plan view of a turbine wheel and of guide vanes, arranged radially around the turbine wheel, in an open position of the guide vanes.
Figure 3:
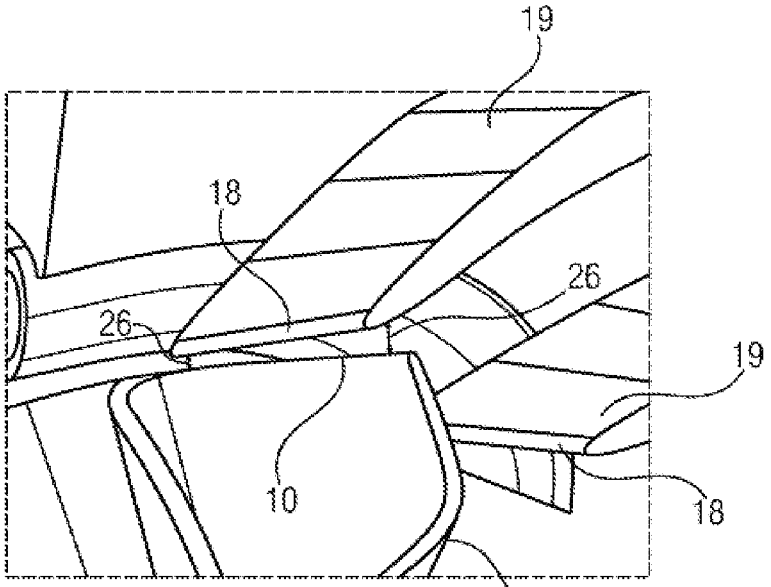
FIG. 3 is a perspective illustration of an inlet edge and of a closest vane trailing edge.

FIG. 2 shows a plan view of the turbine wheel 4 and the guide vanes 14 of the turbine shown in FIG. 1, in the open position of the guide vanes 14. For a better illustration, it is the case here that, inter alia, the bearing housing 9 and the disk 15 have been omitted. FIG. 3 shows an enlarged view of the detail A from FIG. 2 in a perspective illustration. As emerges from FIGS. 2 and 3, the guide vanes 14 have an arched guide vane surface 19. For this reason, the guide vane surface 19 can be seen in the plan view of FIG. 2. In addition to the inclined inlet edge 10 of the turbine wheel 4, the guide vanes 14 likewise have inclined vane edges 18 in order to conduct the exhaust-gas mass flow cleanly to a point as close as possible to the turbine wheel 4. This emerges in particular from the perspective illustration of the inlet edge 10 and of the vane trailing edge 18 in FIG. 3.

Figure 4:
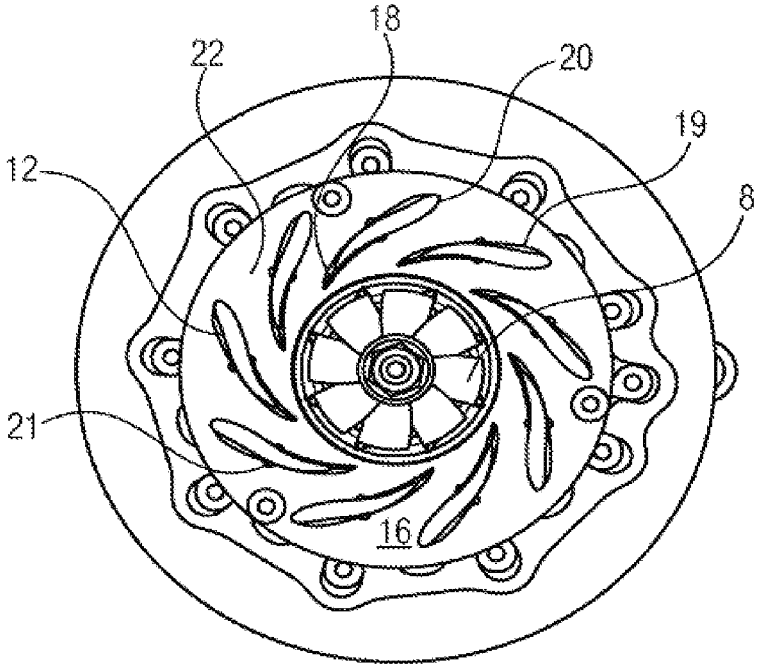
FIG. 4 shows the arrangement from FIG. 2 in a middle blade position.
Figure 5:
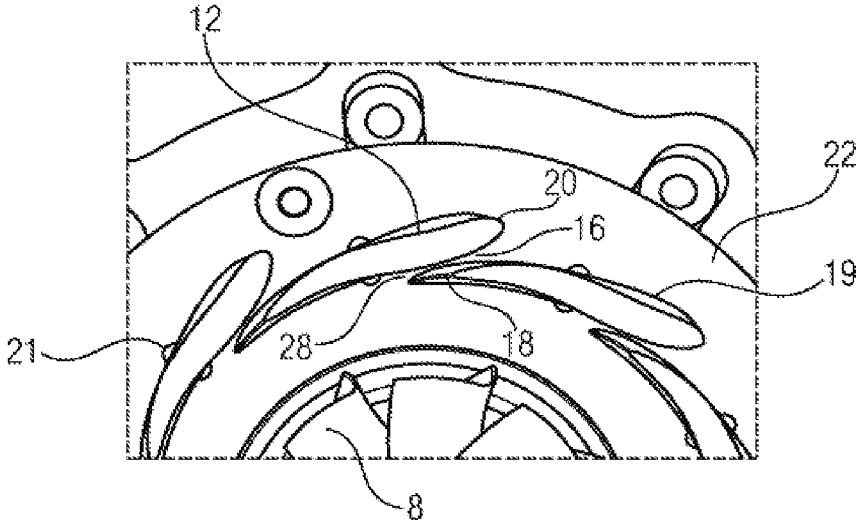
FIG. 5 shows an enlarged view of the arrangement from FIG. 2, in a closed position of the guide vanes.

FIGS. 4 and 5 show the arrangement from FIG. 2 in a middle guide vane position and in a closed position of the guide vanes 14 respectively. It can be clearly seen in particular in FIG. 5 that the vane leading edge 20 and the vane trailing edge 18 of two adjacent guide vanes 14 are shaped so as to form a streamlined nozzle 28 for guidance of the exhaust-gas mass flow to the turbine wheel 4. In this figure, the nozzle 28 can be seen as aperture 28.

FIGS. 6A to 6D show various cross sections of different-shaped guide vanes 14 perpendicular to the axis of rotation 7. A profile centerline 30 of the guide vane 14 divides a cross section of the guide vane 14 along the length 31 thereof into two halves of equal thickness. The profile centerline 30 extends in this case from the vane trailing edge 18 to the vane leading edge 20.

In FIG. 6A, the profile centerline is a straight line, whereas, in FIG. 6B, the profile centerline 30 is curved and has a constant radius of curvature with a finite value. By contrast, the profile centerline 30 from FIG. 6C has two regions of different curvature with in each case different radii of curvature. Shown finally is the profile centerline 30 from FIG. 6D, which is curved in sections and straight in sections.

A perspective view of a guide vane 14, which has not yet been installed and which has a guide vane shaft 5, from the exhaust-gas turbocharger 1 shown in FIGS. 1 to 5 is shown once again in FIG. 7 for illustrative purposes. At a side 35' facing toward the disk 15, the guide vane 14 has a cross section shown in FIG. 6D. At a side 34' facing toward the vane bearing ring, the guide vane 14 has the cross section shown in FIG. 6D, wherein the two cross sections are twisted relative to one another by an angle $\alpha$ of 10° (cf. FIG. 9). It is alternatively also possible for at least two cross sections of in each case one guide vane 14 to have in each case a different shape perpendicular to the axis of rotation 7 of the turbine wheel 4. Accordingly, it may be provided that a single guide vane 14 has all of the cross sections from FIGS. 6A to 6D.

Different flow filaments or flow lines 33 are defined in each case by a smallest spacing on the guide vane surface 19 from the vane leading edge 20 to the vane trailing edge 18. To ensure that exhaust-gas mass flows cover flow paths of equal length on in each case one guide vane surface 19 to the turbine wheel 4, different flow filaments or flow lines 33 are each of the same length.

Figure 8:
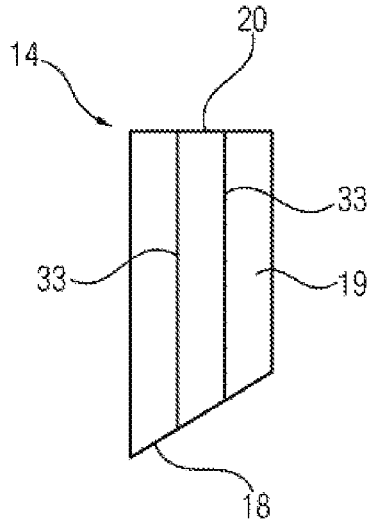
FIG. 8 shows a front view of two guide vanes.

FIG. 8 shows a further schematic view of the guide vane 14 from FIGS. 1 to 5 and 7. The flow filaments or flow lines 33 in FIG. 8 are of equal length. To ensure this, the guide vane 14 is twisted, that is to say the guide vane surface 19 is of arched form.

Figure 9:
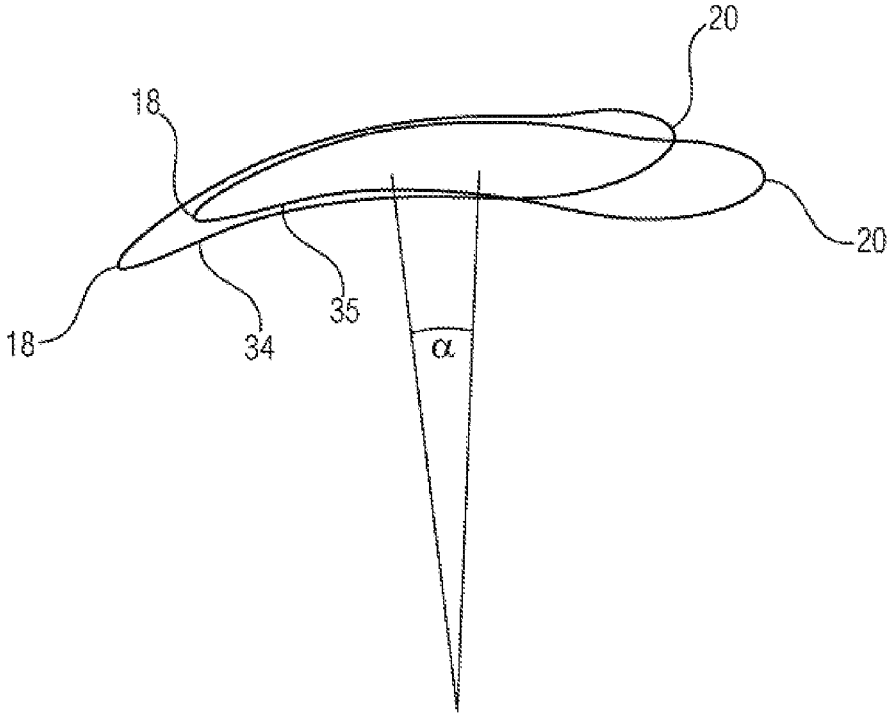
FIG. 9 shows cross sections, inclined by an angle α, of a guide vane.

FIG. 9 shows two cross sections, perpendicular to the axis of rotation 7 of the turbine wheel 4, of the guide vane 14 shown in FIGS. 1-5, 7 and 8. Here, it can be seen that a first cross section 34 of the guide vane 14 is, at the side 34' facing toward the vane bearing ring, inclined by the angle $\alpha$ of 10° relative to a second cross section 35 of the guide vane 14 at the side 35' facing toward the disk 15.

Figure 10:
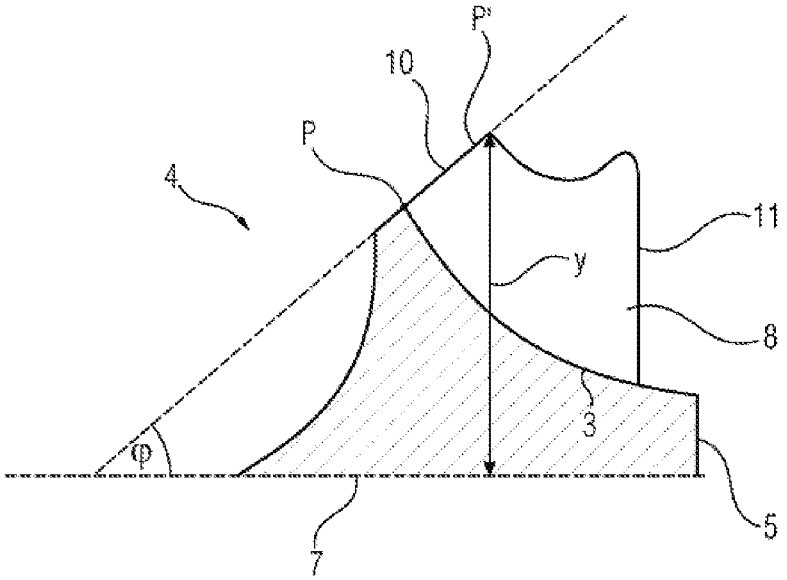
FIG. 10 is a schematic illustration of the turbine wheel from FIGS. 1-5.

In FIG. 10, the turbine wheel 4 with semi-axial inflow from FIGS. 1 to 5 is shown once again in a schematic illustration. In said FIG. 10, it can be seen that a plane is spanned by the axis of rotation 7 of the turbine wheel 4 and by at least one point P that lies on the inlet edge 10. The projection of the inlet edge 10 onto said plane is inclined axially by the angle $\varphi$ relative to the axis of rotation 7 of the turbine wheel 4.

Aside from the point P that is likewise shown in FIG. 1, it is also possible to select some other point P' at some other location on the inlet edge 10. The projection onto the plane defined by the point P' and by the axis of rotation 7 is, in this case too, inclined by the angle $\varphi$.

Only features of the various embodiments that are disclosed in the exemplary embodiments may be combined with one another and individually claimed.

The invention claimed is:

1. An exhaust-gas turbocharger, comprising:

a turbine housing;

a turbine with a turbine wheel axially mounted in said turbine housing and rotatable about an axis of rotation;

said turbine wheel having turbine vanes each formed with an inlet edge for a medium flow;

an adjustable guide grate disposed in said turbine housing, said adjustable guide grate having a multiplicity of guide vanes for a variable adjustment of a flow cross section with respect to said inlet edges of said turbine wheel;

each of said guide vanes having a continuous vane trailing edge, facing toward said turbine wheel, and a continuous vane leading edge averted from said turbine wheel;

wherein a plane is spanned by the axis of rotation of said turbine wheel and at least one point on said inlet edge, and wherein a projection of said inlet edge onto said plane is, at least in one region, axially inclined relative to the axis of rotation of said turbine wheel, and said guide vanes are, at least in said at least one region, arranged radially around said turbine wheel;

wherein different flow-lines define in each case a smallest spacing, on a guide vane surface, from said vane leading edge to said vane trailing edge, wherein the different flow-lines have an equal length;

wherein each of said guide vanes has a main body with at least two cross sections that have mutually different shapes perpendicular to the axis of rotation, and said at least two cross sections are located completely within a region bounded by said continuous vane trailing edge and said continuous vane leading edge;

wherein a first one of said at least two cross sections of a respective said guide vane perpendicular to the axis of rotation of said turbine wheel is inclined by an angle relative to a second one of said at least two cross sections of the respective said guide vane perpendicular to the axis of rotation of said turbine wheel; and wherein said guide vanes are located on rotatable guide vane shafts that are parallel to said axis of rotation of said turbine wheel; and wherein said vane trailing edge of a respective said guide vane runs parallel to said inlet edge of a respectively closest said turbine vane.

2. The exhaust-gas turbocharger according to claim 1, wherein the axially inclined projection of said inlet edge is, in sections, inclined by an angle $\varphi$ of at least 30° in relation to the axis of rotation of said turbine wheel.

3. The exhaust-gas turbocharger according to claim 1, wherein a projection of said vane trailing edge onto said plane is, at least in said at least one region, axially inclined relative to the axis of rotation.

4. The exhaust-gas turbocharger according to claim 1, wherein said guide vanes are adjustably mounted between an open position and a closed position, and wherein, at least in the open position, a minimum radial spacing of the vane trailing edge of a respective said guide vane perpendicular to the axis of rotation of said turbine wheel is smaller than a maximum radial spacing of said inlet edge of a respectively closest turbine vane perpendicular to the axis of rotation of said turbine wheel.

5. The exhaust-gas turbocharger according to claim 4, wherein said vane leading edge of a first one of said guide vanes and said vane trailing edge of a second one of said guide vanes that is adjacent to said first one of said guide vanes are shaped such that, in a closed position of said first and second guide vanes, the respective said leading and trailing edges form an aperture for guiding the medium flow to the turbine wheel.

6. The exhaust-gas turbocharger according to claim 1, wherein profile centerlines of a respective said guide vane each divide one cross section of said guide vane perpendicular to the axis of rotation along a length thereof into two halves of equal thickness, and said profile centerlines extend from said vane leading edge to said vane trailing edge of said guide vane, and wherein said profile centerlines include sections that are curved.

7. The exhaust-gas turbocharger according to claim 1, wherein said guide vane surface guides the medium flow, extends from said vane leading edge to said vane trailing edge of said guide vane, and is arched.

* * * * *